US006953064B2

(12) United States Patent
Golz

(10) Patent No.: US 6,953,064 B2
(45) Date of Patent: Oct. 11, 2005

(54) GROMMETED WEB SECTION AND METHOD OF MAKING

(75) Inventor: Robert E. Golz, Swansea, MA (US)

(73) Assignee: Murdock Webbing Co., Inc., Central Falls, RI (US)

( * ) Notice: Subject to any disclaimer, the term of this patent is extended or adjusted under 35 U.S.C. 154(b) by 422 days.

(21) Appl. No.: 10/200,427

(22) Filed: Jul. 22, 2002

(65) Prior Publication Data

US 2004/0011418 A1 Jan. 22, 2004

(51) Int. Cl.[7] ..... B32B 3/06

(52) U.S. Cl. ..... 139/383 R; 139/DIG. 1; 428/99; 473/539

(58) Field of Search ..... 139/DIG. 1, 383 R; 428/99; 473/539

(56) References Cited

U.S. PATENT DOCUMENTS

| | | | | |
|---|---|---|---|---|
| 875,439 | A | | 12/1907 | Kops |
| 989,985 | A | | 4/1911 | Kops |
| 997,747 | A | | 7/1911 | Brown |
| 1,042,632 | A | | 10/1912 | White |
| 1,075,831 | A | | 10/1913 | Kops |
| 1,373,457 | A | | 4/1921 | Smith |
| 1,475,859 | A | | 11/1923 | Nyman |
| 2,549,382 | A | | 4/1951 | Mitterway |
| 2,558,336 | A | | 6/1951 | Boivin |
| 3,099,331 | A | | 7/1963 | Rose |
| 3,322,163 | A | | 5/1967 | Hughes |
| 3,464,459 | A | | 9/1969 | Ballard |
| 3,612,110 | A | | 10/1971 | Wildi et al. |
| 3,662,787 | A | | 5/1972 | Schiappa et al. |
| 3,872,895 | A | | 3/1975 | Takada |
| 3,897,106 | A | | 7/1975 | Takada |
| 4,228,829 | A | | 10/1980 | Kikuchi |
| 4,253,544 | A | | 3/1981 | Dalmaso |
| 4,446,944 | A | | 5/1984 | Forrest et al. |
| 4,477,928 | A | | 10/1984 | Graff |
| 4,538,702 | A | | 9/1985 | Wolner |
| 4,735,035 | A | | 4/1988 | Mattioli |
| 4,750,529 | A | | 6/1988 | Watanabe |
| 4,843,807 | A | | 7/1989 | von Danwitz |
| RE33,586 | E | | 5/1991 | Graff |
| 5,173,358 | A | * | 12/1992 | Anahara et al. ..... 442/206 |
| 5,273,080 | A | | 12/1993 | Morohashi et al. |
| 5,402,832 | A | | 4/1995 | Kamper et al. |
| 5,564,476 | A | | 10/1996 | Golz |
| 5,664,639 | A | | 9/1997 | Worth |
| 5,768,758 | A | | 6/1998 | Deignan et al. |
| 5,787,510 | A | | 8/1998 | Jackson, Jr. |
| 6,006,700 | A | | 12/1999 | Cox |
| 6,085,802 | A | | 7/2000 | Silberberg |
| 6,221,458 | B1 | * | 4/2001 | Armendariz ..... 428/99 |
| 6,451,405 | B1 | * | 9/2002 | Diemer ..... 428/100 |

* cited by examiner

*Primary Examiner*—John J. Calvert
*Assistant Examiner*—Robert H. Muromoto
(74) *Attorney, Agent, or Firm*—Salter & Michaelson

(57) ABSTRACT

A web having at least two types of weaves is provided. The construction of the web allows objects to be inserted into and through the web without detriment to the yarns of the web. The web is particularly useful for applications requiring the insertion of fasteners such as grommets into the web.

16 Claims, 10 Drawing Sheets

SELF INTERLOCKING TYPE 19 WEAVE

SELF INTERLOCKING TYPE 26 WEAVE

GROMMETED WEB SECTION AND METHOD OF MAKING

BACKGROUND

1. Technical Field

The present application is directed to a web section and method of making and, in particular, to a web section that includes at least one fastener and a method of making such a web section.

2. Related Art

Commercially available webs are formed from a variety of different weaves and are used to form a variety of products. In many instances, fasteners, grommets, buckles, or other fastener or engagement mechanisms are attached or inserted into the web for various reasons. For example, belt buckles formed from a web generally include a buckle at one end and a plurality of grommets inserted through the opposite end for receiving the buckle therein. Some safety harnesses utilize such an arrangement.

Depending on the type of weave, when a fastener such as, for example, a grommet is inserted into and through some types of webs, the warp and/or weft yarns may be torn. As a result of the torn yarns, frayed edges may develop around the grommets over time, the retention of the grommet is less certain over time, and the harness must be discarded. In addition, in some instances, dimpling may occur on the edge of a web after a grommet has been inserted into and through the web. Although not detrimental to the strength of the web, this creates uncertainty and loss of confidence in users of products formed from the webs, particularly users of safety harnesses.

Referring to FIGS. 1–4, there is indicated generally at 10 a section of a typical elongated webbing suitable for use in commercial settings, such as for strapping, safety ropes, and the like. As shown, webbing section 10 includes a main body 12 formed from warp yarns 14 packed to form a generally rectangular cross-section having a front surface 16 and a back surface 18 (see FIG. 4) and relatively narrow edges 20, 22. Main body 12 further includes weft or fill yarns 24 extending transversely with respect to warp yarns 14. Web section 10 is illustrated using what is known in the art as a double plain weave, self interlocking weave, which is a typical weave used to make, for example, belts and safety harnesses.

Web section 10 includes grommets 26 which extend from front surface 16 to back surface 18, as best shown in FIG. 4. Grommets 26 are typically inserted into a web section by punching two mating sections 26*a*, 26*b* into and through web 10 until they are interengaged with one another. During the attachment process, warp yarns 14 and weft yarns 24 in region 28 (see FIG. 4) are purposely either cut with a punch or hot cut in order to accommodate grommet 26, in either case damaging the warp and filling yarns. Thus, warp and weft yarns 14, 24 adjacent to grommet 26 may be damaged and, as a result, may become frayed over time, as best shown in FIG. 5.

In addition, the attachment of grommets 26 to web section 10 may result in dimples 30 being formed along edges 20, 22. Dimples 30 are typically the result of the weft yarns being pulled slightly when the grommet section 26*a, b* are inserted. Again, although not detrimental to the strength of the web, dimples may create loss of confidence in users of products formed from the webs, particularly users of safety harnesses.

Thus, there is need in the art for a web that allows grommets to be more securely inserted into the web without cutting yarns and without dimpling the edges.

SUMMARY

One embodiment of the present disclosure is a web section that includes a plurality of weft yarns transverse to a plurality of warp yarns. The web section includes a first region comprising a self-interlocking weave in the center of the webbing and a second region adjacent the first region. The second region comprises a double plain weave. The web section also includes a third region adjacent the first region. The third region comprises a double plain weave. At least one fastener is positioned between the warp and weft yarns of the first weave. Another embodiment of the present disclosure is a web section including a plurality of weft yarns transverse to a plurality of warp yarns. The web section comprises a first region comprising a first weave and a second region adjacent the first region. The second region comprises a second weave different from the first weave. The web section also includes a third region adjacent the first region. The third region comprises a third weave different from the first weave. At least one fastener is positioned between the warp and weft yarns of the first weave.

In yet another embodiment, the a web section includes a plurality of weft yarns transverse to a plurality of warp yarns. The web section includes a first region comprising a first weave and a second region comprising a second weave. The second weave is different from the first weave. At least one fastener is positioned between the warp and weft yarns of the first region. The width of the web section is substantially uniform in a longitudinal direction along the entire length of the web section.

In yet another embodiment, the web section includes a first region comprising a first weave and a second region comprising a second weave different from the first weave. The first region is adjacent the second region. At least one fastener is positioned between the warp and weft yarns of the first region.

The foregoing and other objects, features and advantages of the disclosure will be apparent from the following more particular description of preferred embodiments of the disclosure, as illustrated in the accompanying drawings in which like reference characters refer to the same parts throughout the different views. The drawings are not necessarily to scale, emphasis instead being placed upon illustrating the principles of the disclosure. The principles and features of this disclosure may be employed in varied and numerous embodiments without departing from the scope of the disclosure.

DETAILED DESCRIPTION OF THE PREFERRED EMBODIMENTS

The present disclosure is directed to a web section formed using selected weaves that allow penetration of the warp and weft yarns by an object without tearing the warp and/or weft yarns. The construction of the web allows, for example, fasteners such as grommets to be inserted into and through the web section between the warp and weft yarns. Thus, damage to the warp and/or weft yarns is eliminated during the attachment of the grommets. In some embodiments, the construction of the web section may eliminate dimpling often seen on the edges of a web section after a grommet is attached to the web section. Thus, the width of the web remains substantially unchanged or uniform in a longitudinal direction along the entire length of the web section.

Figure 6:
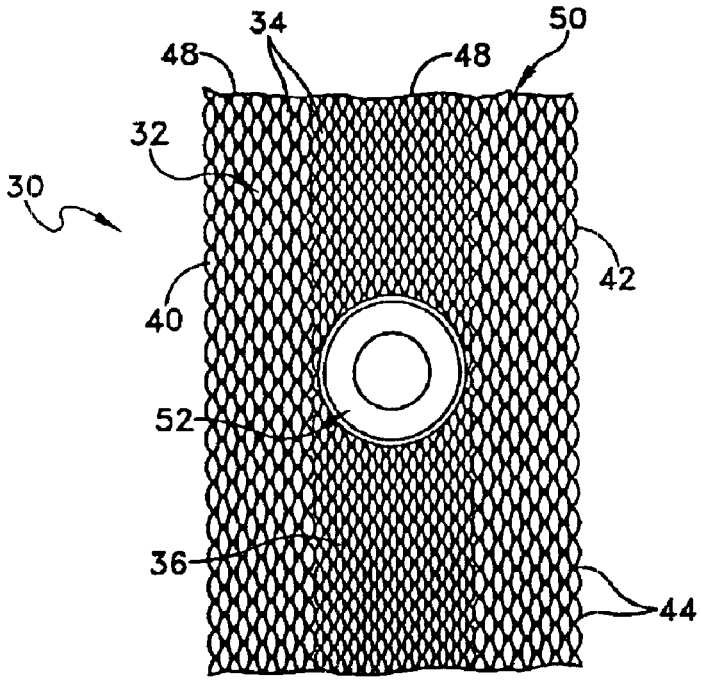
FIG. 6 is a top view of one embodiment of a web section according to the present disclosure.
Figure 7:
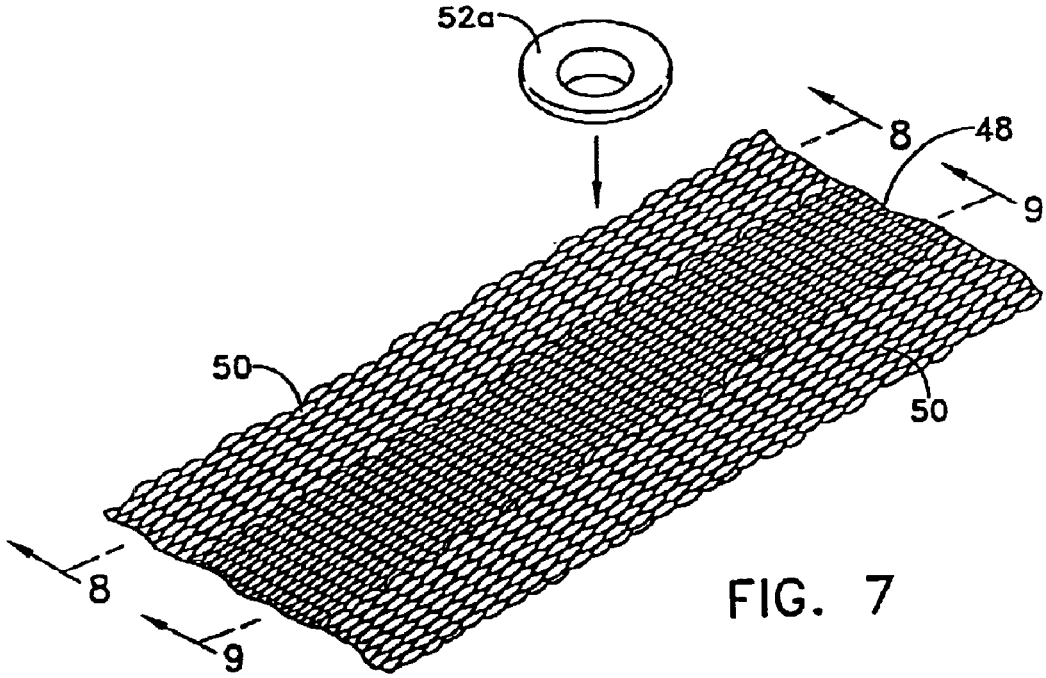
FIG. 7 is a perspective view showing the method of inserting grommets into the web section of FIG. 1.

Referring now to FIG. 6, there is indicated generally at 30 one embodiment of a section of an elongate webbing, section 30 suitable for use in commercial settings, such as for strapping, safety ropes, and the like. As shown, webbing section 30 includes a main body 32 formed from warp yarns 34 packed to form a generally rectangular cross-section having a front surface 36 and a back surface 38 (see FIG. 11) and relatively narrow edges 40,42. Main body 32 further includes weft or fill yarns 44 extending transversely with respect to warp yarns 34. The warp and weft yarns may be fabricated from any suitable fiber, as will be apparent to those of ordinary skill in the art.

As shown, web section 30 includes a center region 48 formed from a first weave and at least one side region 50 formed from a second weave that is different from the first weave. Although illustrated herein with two side regions 50, one adjacent each side of center region 48, it should be understood that two side regions 50 are not necessary to the disclosure (as shown in the embodiment illustrated in FIGS. 12–15).

Figure 9:
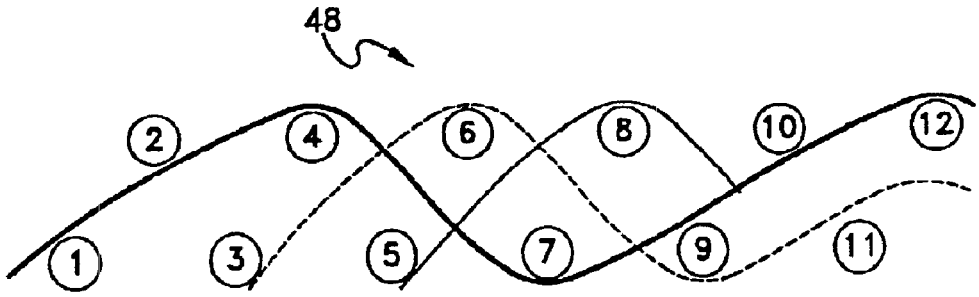
FIG. 9 is a graphical illustration of the weave of the web section of FIG. 7 through Line 9—9.
Figure 9A:
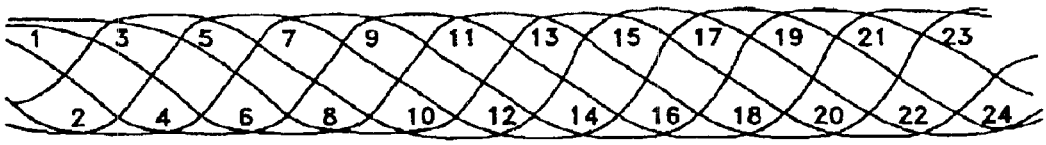
FIG. 9A is a graphical illustration of additional weaves that may be used for the center region of the web section.
Figure 9A:
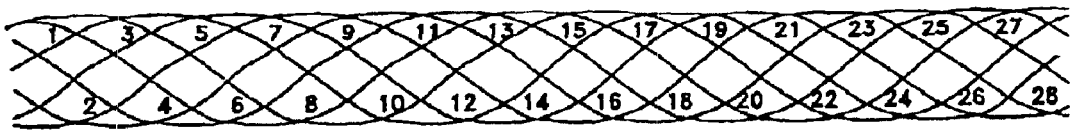
Figure 9B:
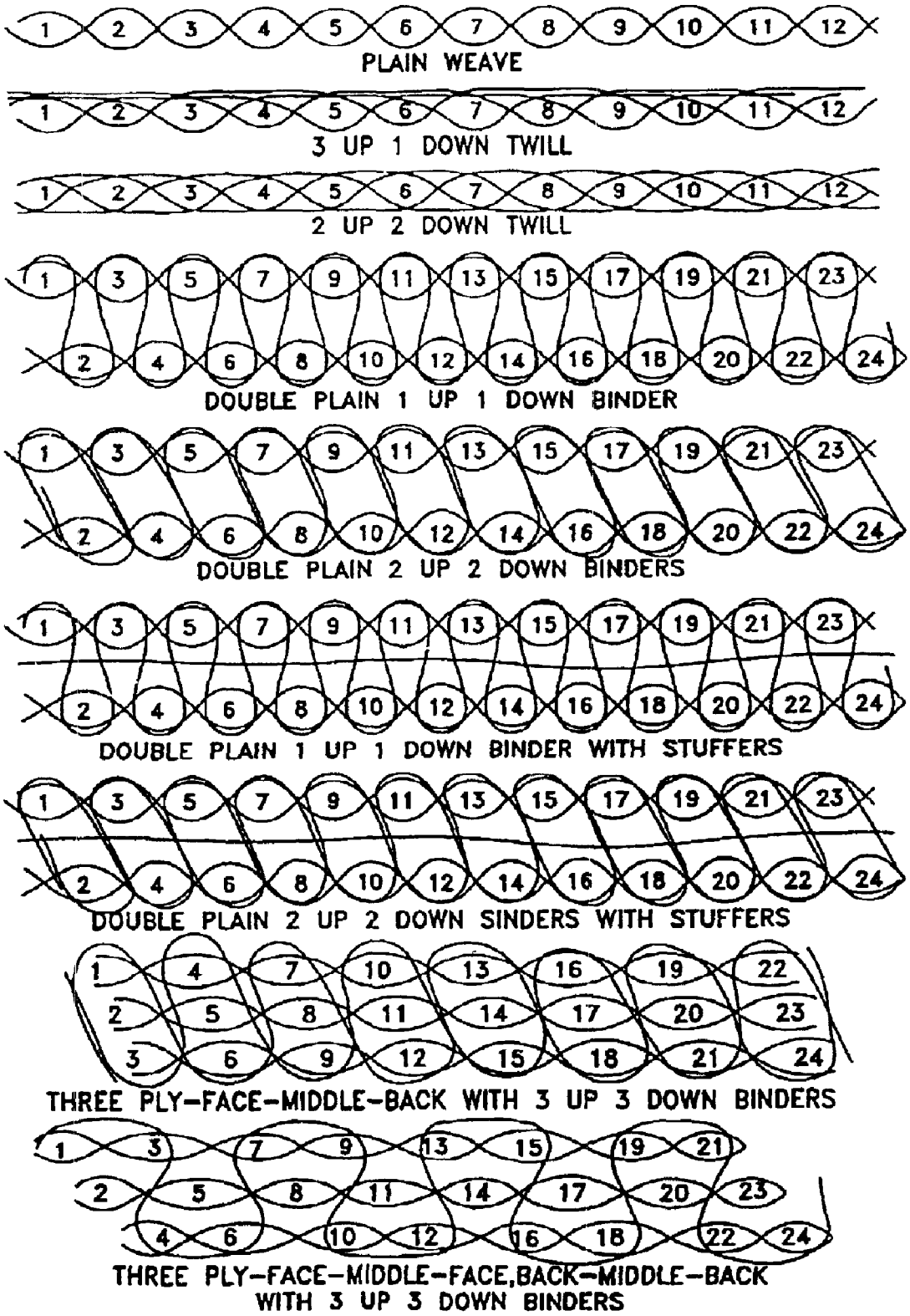
FIG. 9B is a graphical illustration of additional weaves that may be used for the side regions of the web section.

Center region 48 may be formed from the same type of weave that allows the warp yarns 34 and the weft yarns 42 to slide apart when, for example, a fastening article such as a grommet is attached to the web section. Such weaves are generally relatively looser or less dense weaves than those that are preferred for the side regions, which allows the warp and weft yarns to be displaced during insertion of an object into the web. One type of weave that has been found suitable for center region 48 is what is known in the art as a self-interlocking weave. A particularly preferred self-interlocking weave is illustrated graphically in FIG. 9 (in which the numbered circles designate warp yarns extending perpendicular to the sheet of paper, and the weft yarns are designated by lines on the sheet of paper). Those of skill in the art will recognize that any weave that allows warp yarns 34 and weft yarns 42 to slide apart during insertion of objects may be used in center region 48. Examples of other weaves that may be suitable for center region 48 include, but are not limited to, 8-pick, 12-pick, and 14-pick self-interlocking weaves. In general, increasing number of picks in a weave will provide a looser weave.

Figure 8:
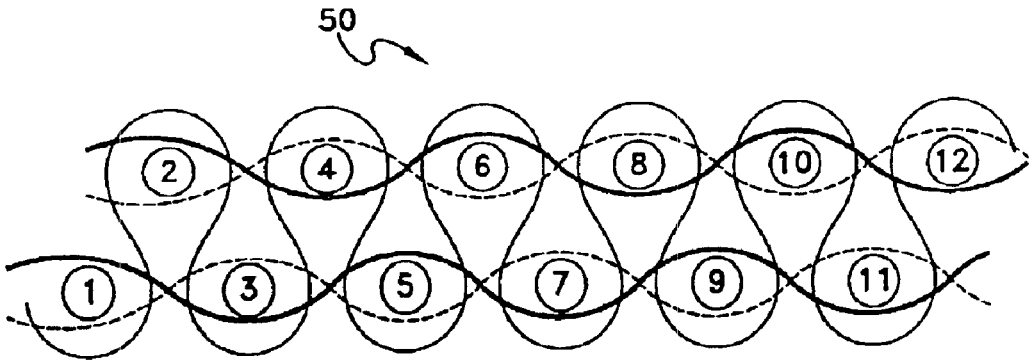
FIG. 8 is a graphical illustration of the weave of the web section of FIG. 7 through Line 8—8.

Side regions 50 may be formed from any type of weave that does not allow or at least limits the sliding of warp yarns 34 and weft yarns 42 when an object is inserted into the web section. Such weaves are generally relatively tighter or denser weaves than those that are preferred for the center region, which minimizes or prevents the warp and weft yarns from being pulled toward the center region of the web section during insertion of an object into the web. One type of weave that has been found suitable for side regions 50 is a double plain weave. A particularly preferred double plain weave is illustrated graphically in FIG. 8. Those of skill in the art will recognize that any weave that prevents or limits movement of the warp yarns 34 and weft yarns 42 may be used in side regions 50. Examples of other weaves that may be suitable for side regions 50 include, but are not limited to, plain weave, 2-up 2-down twill weave, 3-up 1-down twill weave, 3-ply weaves, stuffer construction, and any variation of the foregoing weaves.

Those of skill in the art will recognize that when two side regions 50 are used, it is not necessary for the two to be formed from the same weave.

In the present embodiment, web section 30 also includes at least one grommet 52 positioned in center region 48 and extending from front surface 36 to back surface 38.

Figure 10:
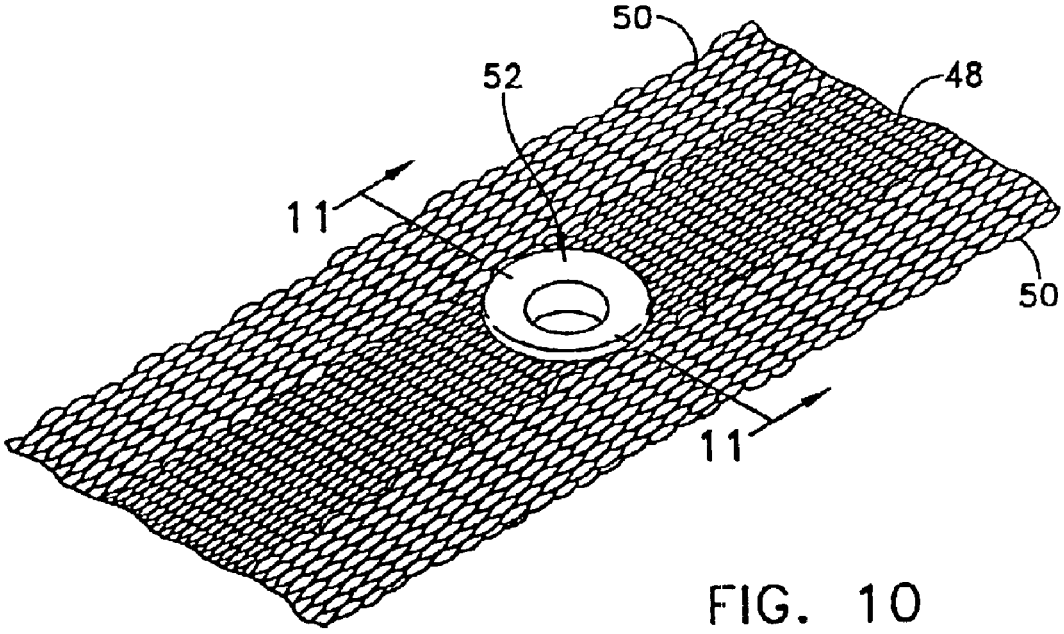
FIG. 10 is a perspective view of the web section of FIG. 6.
Figure 11:
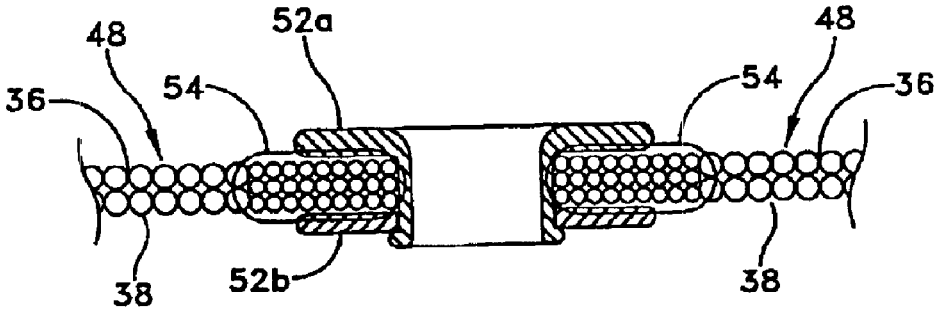
FIG. 11 is a cross-section of the web section of FIG. 10 through Line 11—11.
Figure 12:
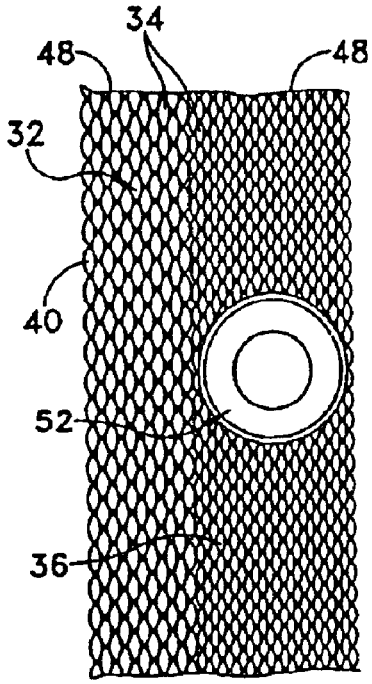
FIG. 12 is a top view of another embodiment of a web section according to the present disclosure.
Figure 13:
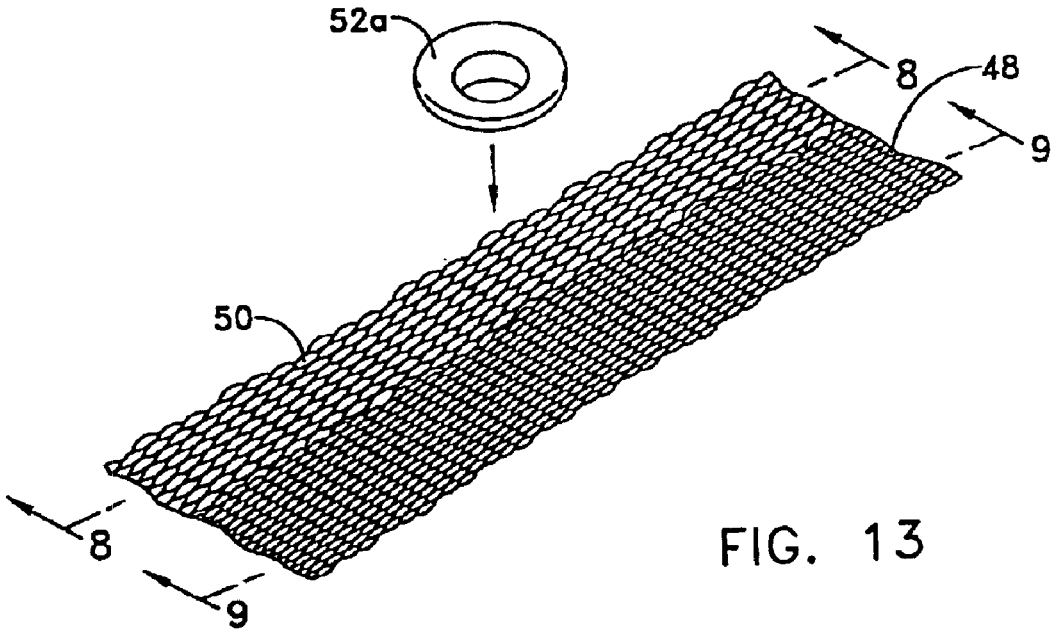
FIG. 13 is a perspective view showing the method of inserting the grommets into the web section of FIG. 12.

As shown in FIGS. 10 and 11, warp yarns 34 adjacent grommet 52 are not torn during attachment of the grommet because, due to the type of weave selected for center region 48, they merely slide out of the way. Thus, as grommet 52 is inserted into and through web section 30, warp yarns 34 and weft yarns 42 become compressed in region 54 adjacent grommet 52. As a result, warp yarns 34 adjacent grommet 52 remain intact, and are not broken. Moreover, because warp yarns 34 are not pulled toward the grommets during insertion, dimples are not formed on edges 40,42 after insertion of grommet 52.

Figure 1:
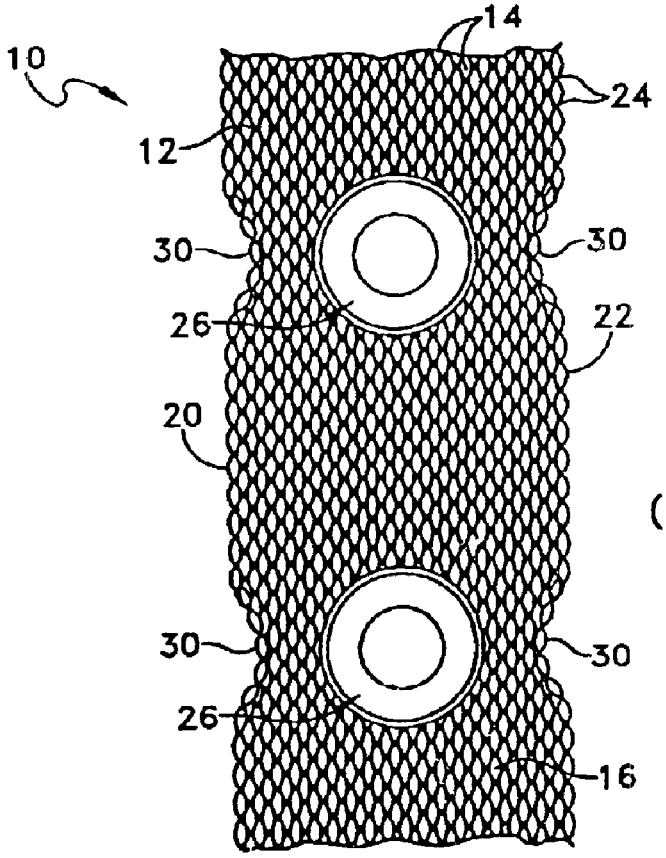
FIG. 1 (PRIOR ART)
FIG. 1 is a top view of a prior art web section with grommets inserted into the web.
Figure 2:
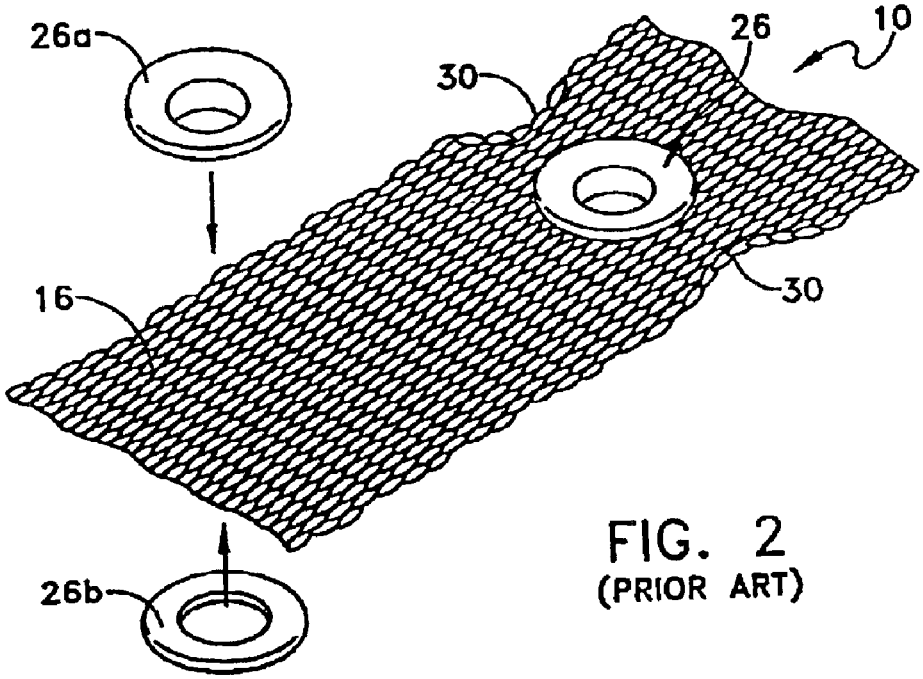
FIG. 2 (PRIOR ART)
FIG. 2 is a perspective view showing the method of inserting grommets into the web section of FIG. 1.
Figure 3:
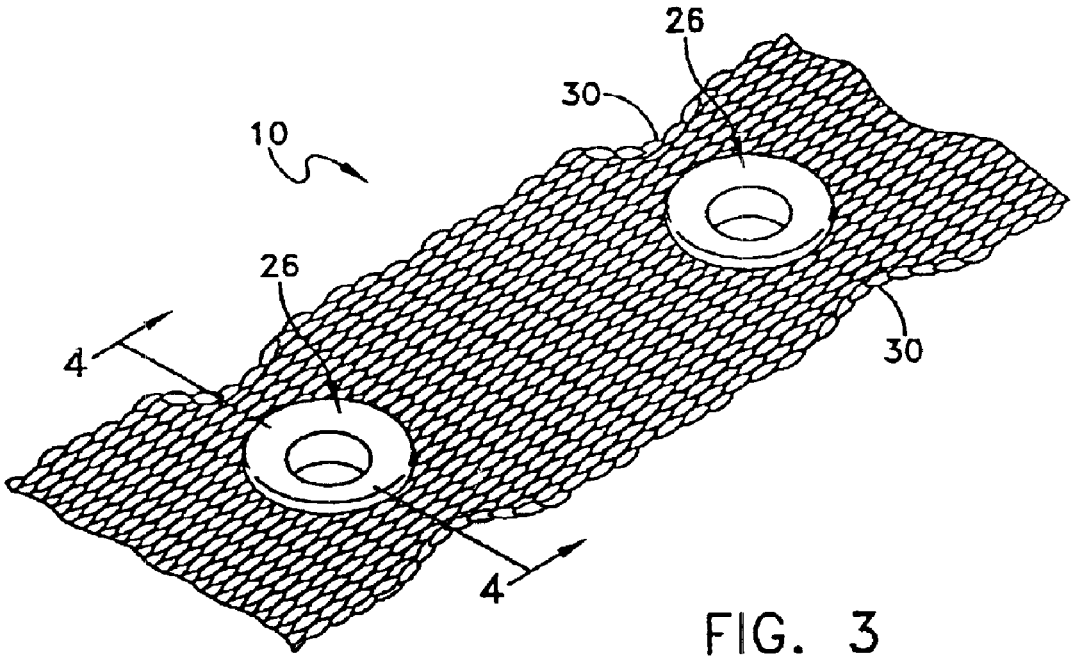
FIG. 3 (PRIOR ART)
FIG. 3 is a perspective view of the web section of FIG. 1.
Figure 4:
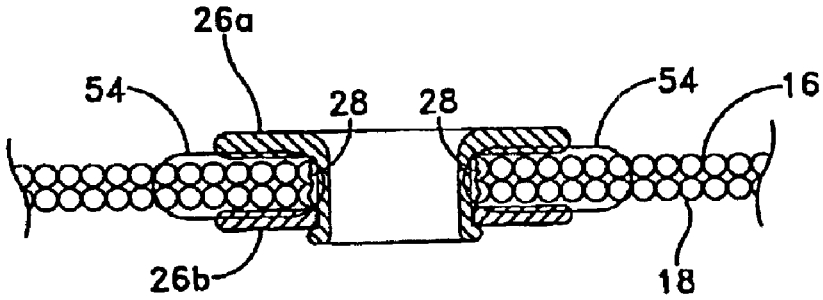
FIG. 4 (PRIOR ART)
FIG. 4 is a cross-section of the web section of FIG. 3 through Line 4—4.
Figure 5:
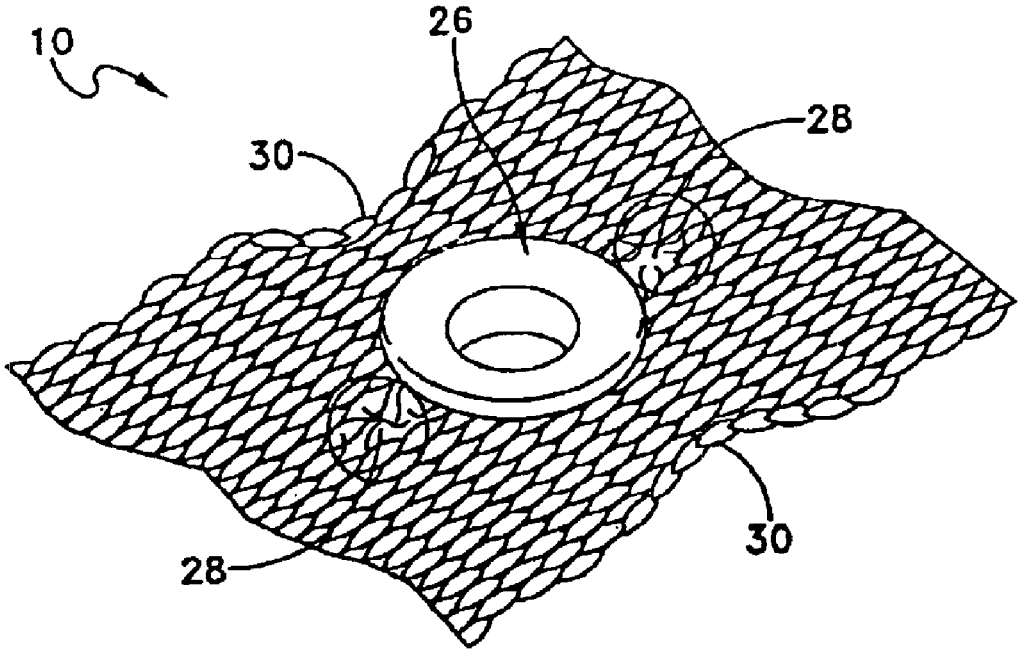
FIG. 5 (PRIOR ART)
FIG. 5 is a perspective view of the web section of FIGS. 1–4 showing the fraying of the yarns adjacent to the grommet which occurs over a period of time.

Referring now to FIGS. 12–15, there is indicated generally at 130 another embodiment of a section of an elongate webbing suitable for use in commercial settings, such as for strapping, safety ropes, and the like. As shown, webbing section 130 includes a main body 32 formed from warp yarns 34 packed to form a generally rectangular cross-section having a front surface 36 and a back surface 38 (see FIG. 1) and relatively narrow edges 40,42. Main body 32 further includes weft or fill yarns 44 extending transversely with respect to warp yarns 34. The warp and weft yarns may be fabricated from any suitable fiber, as will be apparent to those of ordinary skill in the art.

As shown, web section 130 includes a first region 48 formed from a first weave and a second region 50 formed from a second weave that is different from the first weave. First region 48 may be formed from the same type of weave as described above with reference to region 48. Region 50 may be formed from the same type of weave as described above with reference to region 50. In the present embodiment, web section 130 also includes at least one grommet 52 positioned in region 48 and extending from front surface 36 to back surface 38.

Figure 14:
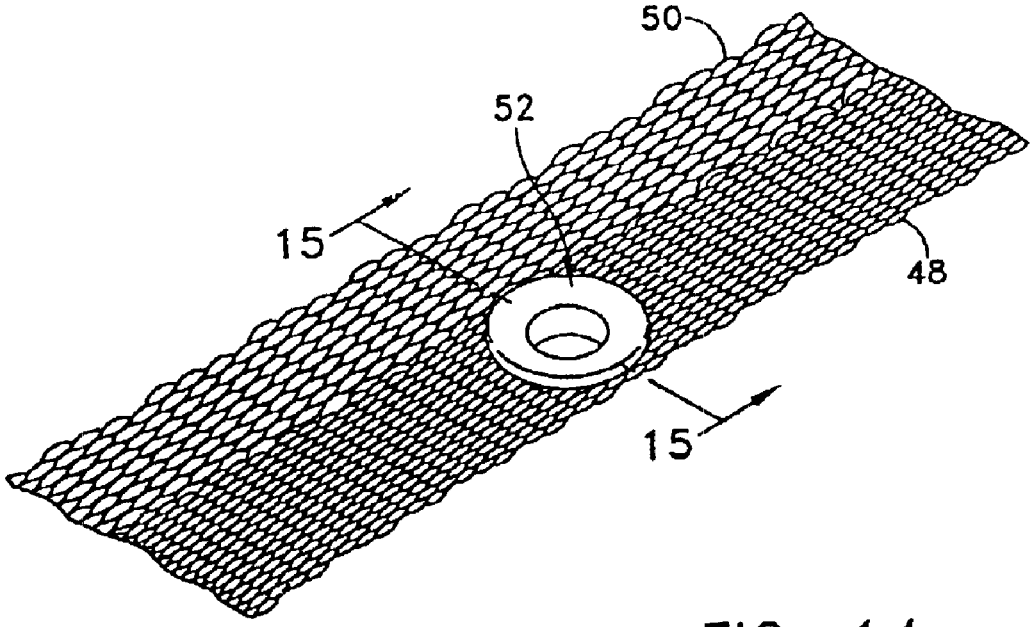
FIG. 14 is a perspective view of the web section of FIG. 13 after the grommets have been inserted.
Figure 15:
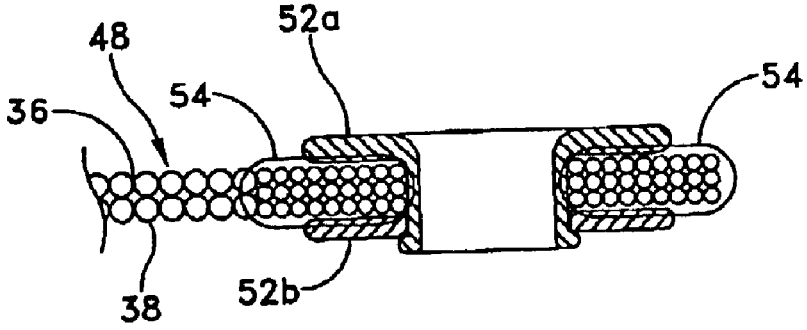
FIG. 15 is a cross-section of the web section of FIG. 14 through Line 15—15.

As in the previous embodiment, and as shown in FIGS. 14 and 15, warp yarns 34 adjacent grommet 52 are not torn during attachment of the grommet because, due to the type of weave selected for center region 48, they merely slide out of the way. Thus, a grommet 52 is inserted into and through web section 130, warp yarns 34 and weft yarns 42 become compressed in region 54 adjacent grommet 52. As a result, warp yarns 34 adjacent grommet 52 remain intact, and are not broken. Moreover, because warp yarns 34 are not pulled toward the grommets during insertion, dimples are not formed on edges 40,42 after insertion of grommet 52.

Although particular embodiments of the disclosure have been described in detail for purposes of illustration various changes and modifications may be made without departing from the scope and spirit of the disclosure. All combinations and permutations of the weaves and methods are available for practice in various applications as the need arises. For example, the web sections and webs of the disclosure may be used in applications that are presently not practically feasible. Typical applications include safety harnesses, belts, and slings, and the like. Accordingly, the disclosure is not to be limited except as by the appended claims.

What is claimed is:

1. A web section including a plurality of weft yarns transverse to a plurality of warp yarns, the web section comprising:

a first region comprising a first weave and a second region comprising a second weave different from the first weave, the first region being adjacent the second region; and at least one fastener positioned between the warp and weft yarns of the first region so as not to break the warp and weft yarns as the fastener is inserted into and through the web section.

2. The web section of claim 1, wherein the first weave is a self-interlocking weave.

3. The web section of claim 2, wherein the first weave is selected from the group consisting of 8-pick, 12 pick and 14 pick self-interlocking weaves, and combinations thereof.

4. The web section of claim 1, wherein the second weave is selected from the group consisting of a plain weave, a double-plain weave, a 2-up, 2-down twill weave, a 3-up, 3-down twill weave, a 3-ply weave, a stuffer construction, and combinations thereof.

5. The web section of claim 1, wherein the first weave is a self-interlocking weave and the second weave is a double plain weave.

6. A web section including a plurality of weft yarns transverse to a plurality of warp yarns, the web section comprising:

a first region comprising a first weave and a second region comprising a second weave different from the first weave, the first region being adjacent the second region;

a third region adjacent to the first region, the third region comprising a third weave that is different from the second weave; and at least one fastener positioned between the warp and weft yarns of the first region.

7. The web section of claim 1, wherein the first region and the at least one fastener each have a predetermined width, and the width of the at least one fastener is less than the width of the first region.

8. The web section of claim 1, wherein the first region has a width less than the width of the second region.

9. The web section of claim 1, wherein the width of the web section is substantially uniform in a longitudinal direction along the entire length of the web section.

10. The web section of claim 6, wherein the width of the web section is substantially uniform in a longitudinal direction along the entire length of the web section.

11. A web section including a plurality of weft yarns transverse to a plurality of warn yarns, the web section comprising:

a first region comprising a first weave and a second region comprising a second weave different from the first weave, the first region being adjacent the second region;

a third region adjacent to the first region; and at least one fastener positioned between the warp and weft yarns of the first region;

wherein the second region and the third region comprise the same weave.

12. The web section of claim 11, wherein the second and third regions comprise a weave that is selected from the group consisting of a plain weave, a double-plain weave, a 2-up, 2-down twill weave, a 3-up, 3-down twill weave, a 3-ply weave, a stuffer construction, and combinations thereof.

13. A web section including a plurality of weft yarns transverse to a plurality of warp yarns, the web section comprising:

a first region comprising a self-interlocking weave;

a second region adjacent the first region, the second region comprising a double plain weave;

a third region adjacent the first region, the third region comprising a double plain weave; and at least one fastener positioned between the warp and weft yarns of the self-interlocking weave.

14. A web section including a plurality of weft yarns transverse to a plurality of warp yarns, the web section comprising:

a first region comprising a first weave;

a second region adjacent the first region, the second region comprising a second weave different from the first weave;

a third region adjacent the first region, the third region comprising a third weave different from the first weave; and at least one fastener positioned between the warp and weft yarns of the first weave.

15. The web section of claim 14, wherein the width of the web section is substantially uniform in a longitudinal direction along the entire length of the web section.

16. A web section including a plurality of weft yarns transverse to a plurality of warp yarns, the web section comprising:

a first region comprising a first weave and a second region comprising a second weave, the first weave being different from the second weave; and at least one fastener positioned between the warp and weft yarns of the first region so as not to break the warp and weft yarns as the fastener is inserted into and through the web section;

wherein the width of the web section is substantially uniform in a longitudinal direction along the entire length of the web section.

* * * * *